US006307917B1

(12) United States Patent
Shimizu et al.

(10) Patent No.: US 6,307,917 B1
(45) Date of Patent: Oct. 23, 2001

(54) SOLLER SLIT AND X-RAY APPARATUS

(75) Inventors: Katsuhiko Shimizu; Kazuhiko Omote; Go Fujinawa, all of Tokyo (JP)

(73) Assignee: Rigaku Corporation, Akishima (JP)

( * ) Notice: Subject to any disclaimer, the term of this patent is extended or adjusted under 35 U.S.C. 154(b) by 0 days.

(21) Appl. No.: 09/440,057

(22) Filed: Nov. 15, 1999

(51) Int. Cl.[7] ..... G21K 1/02

(52) U.S. Cl. ..... 378/145; 378/147; 378/149; 378/84

(58) Field of Search ..... 378/145, 147, 378/149, 84, 85

(56) References Cited

U.S. PATENT DOCUMENTS

| | | | | |
|---|---|---|---|---|
| 4,322,618 | * | 3/1982 | Jenkins | 378/84 |
| 4,856,043 | * | 8/1989 | Zola | 378/149 |
| 5,016,267 | * | 5/1991 | Wilkins | 378/84 |
| 6,108,401 | * | 8/2000 | Reefman | 378/83 |

OTHER PUBLICATIONS

B. D. Cullity. Elements of X–Ray Diffraction, second edition (Reading, MA: Addison–Wesley, 1978), p. 196–199 and 426–428.*

* cited by examiner

*Primary Examiner*—Robert H. Kim
*Assistant Examiner*—Allen C. Ho
(74) *Attorney, Agent, or Firm*—Burns, Doane, Swecker & Mathis, LLP

(57) ABSTRACT

A soller slit includes a plurality of metal foils and a plurality of spacers. The spacers are laminated alternatively with the metal foils to support one end portions of the metal foils with a space between adjacent metal foils. The other end portions of the metal foils are opened to be unsupported as a free end. When the soller slit is used in an X-ray apparatus, other X-ray optical components, such as monochromator or a specimen to be analyzed, then the soller slit can be arranged in contact with or in the vicinity of the unsupported end portions of the soller slit. That is, it is possible to unify the soller slit and other X-ray optical components in an assembled state. Therefore, a space dedicated to the soller slit becomes unnecessary. Further, since it is possible to shorten a passage of X-rays correspondingly, attenuation of X-rays to be detected by the X-ray detector can be avoided.

5 Claims, 9 Drawing Sheets

(Y-Y CROSS SECTION)

SOLLER SLIT AND X-RAY APPARATUS

BACKGROUND OF THE INVENTION

1. Field of the Invention

The present invention relates to a soller slit for collimating diverging X-rays to parallel X-rays. Also, the present invention relates to an X-ray apparatus constructed with the same soller slit.

2. Description of the Related Art

There has been known an X-ray apparatus that is an apparatus for analyzing a specimen with using X-rays. Further, there has been known an X-ray apparatus having a structure in which a soller slit for collimating X-rays incident to a specimen or X-rays diffracted by the specimen to parallel X-ray beams by limiting divergence of the X-rays. FIG. 12 shows an example of a conventional X-ray apparatus using such soller slit.

In the X-ray apparatus, a specimen 'S' performs the so-called θ rotation in which the specimen 's' continuously or intermittently rotates about an axis line Xs of the specimen 's' at a predetermined angular speed, and simultaneously, an X-ray counter 51 performs the so-called 2θ rotation in which the X-ray counter 51 rotates about the axis line Xs in the same direction at an angular speed twice the predetermined angular speed. X-rays emitted from an X-ray focal point 'F' are directed through a monochromator slit 52, monochromator 53, a soller slit 54 and a divergence limiting slit 56 to the specimen 'S', while the θ rotation and the 2θ rotation being performed.

The conventional soller slit 54 is constructed by piling up a plurality of thin metal foils 61 with using a spacer between adjacent metal foils, as shown in FIG. 13. A front and rear portions of this soller slit 54 in a propagating direction of an X-ray 'R' are opened to allow the X-ray to pass through and side portions thereof are closed by spacers 59 and side walls 62.

In FIG. 12, the soller slit 54 limits divergence of X-rays generated from the X-ray focal point 'F' and then reflected or diffracted by the monochromator 53, to form parallel X-ray beams incident on the specimen. In some case, the soller slit is arranged between a divergence limiting slit 57 and a light receiving slit 58 to direct X-rays to an X-ray counter 51 by limiting divergence of X-rays diffracted by the specimen 'S'.

In FIG. 12, when Bragg's diffraction condition is satisfied between X-ray incident on the specimen 'S' under the θ rotation and crystal lattice face of the same specimen 'S', X-ray diffraction occurs at the specimen 'S'. Thus diffracted X-rays are detected by the X-ray counter 51 through the scattering ray limiting slit 57 and the light receiving slit 58, which perform 2θ rotations, respectively. On the basis of this detection, both the diffraction angle 2θ and the X-ray intensity regarding X-rays diffracted at the specimen 'S' are measured.

In the X-ray apparatus mentioned above, the soller slit 54 is located in a position remote from other X-ray optical elements such as the monochromator 53 and the specimen 'S' as shown in FIG. 12. Therefore, a space dedicated to the soller slit 54 is required, causing the size of the X-ray apparatus to be large.

SUMMARY OF THE INVENTION

The present invention was made in view of the above mentioned state of art and has an object to remove, in an X-ray apparatus, the necessity of providing a space for arranging a soller slit to thereby increase an X-ray intensity received by the X-ray counter.

(1) In order to achieve the above object, a soller slit according to the present invention, which includes a plurality of metal foils stacked with a constant interval provided by spacers each between adjacent foils, is featured by that the end portion of the metal foils opposite to the spacers are opened. The metal foil can be formed of any metal material, provided that the metal material is impermeable with respect to X-rays. For example, stainless steal may be used therefor.

In the soller slit mentioned above, since one end portion of the metal foils are opened to be a free end, other X-ray optical components such as a monochromator, a specimen, etc., can be arranged in facing relation to the opened portion. Therefore, there is no need of separately providing a space dedicated to the soller slit, causing the size of the X-ray apparatus to be reduced. Further, since reduction of the X-ray apparatus in size makes possible to shorten an X-ray passage, it is possible to increase intensity of X-rays to be detected by an X-ray detector.

Further, the soller slit can be mounted directly on and preferably integrally with the optical component such as the monochromator, so that the optical component and the soller slit are necessarily determined in position relative to each other. As a result, there is no need of separately regulating positions of the soller slit and the optical components opposing to the soller slit in regulating an optical axis regulation related to various X-ray optical components constituting the X-ray apparatus. Therefore, it becomes possible to easily perform an optical axis regulation work related to the X-ray apparatus.

(2) In the X-ray apparatus mentioned above, each spacer can have a configuration having a forwardly peaked center portion of a front end and both end portions thereof behind. In general, the metal foil is very thin and has low rigidity, so that it is easily deformed, for example, warped. On the contrary, when spacers having a configuration mentioned above being used, it is possible to support the metal foils so as to be hardly deformed. Therefore, spacers having a configuration mentioned above are preferable in the case where the metal foils are supported on one sides with the other sides thereof being opened, that is, the metal foils are supported in the form of a cantilever, as in the present invention.

(3) In the case where the metal foils are supported in the form of a cantilever by the spacers as mentioned above, it is preferable to form each spacer having a delta configuration, namely, a form of a mountain equipped with a forward apex. With such configuration of the spacer, it is possible to form the spacer easily while holding the propagation passage of X-rays passing along the metal foils.

When such spacers are arranged in a manner that the forward apexes thereof are positioned extremely close to the specimen or the monochromator, the forward apexes make possible to effectively exclude unnecessary X-rays such as scattered X-rays, which may cause a noise in a result of measurement. Thus, a high signal-to-noise ratio is obtained in a result of measurement, resulting in a reliable result of measurement.

(4) An X-ray apparatus according to the present invention comprises an X-ray source for generating X-rays, an X-ray detector for detecting X-rays diffracted by the specimen after being generated by the X-ray source, and a soller slit. In this X-ray apparatus, the soller slit includes a plurality of metal foils stacked with a constant interval between adjacent foils by spacers. End portions of the stacked metal foils on the side opposite to the spacers constitute an opened end portion. The soller slit is arranged in opposing relation to the specimen with the opened end portion of the metal foils being in contact with or in the vicinity of a surface of the specimen.

According to the aforesaid X-ray apparatus including the soller slit having one end portion opened, the specimen can be arranged in opposing relation to the opened end portion. With this constitution , it is possible to collimate X-rays to parallel X-ray beams by the soller slit, while irradiating the specimen with X-rays and deriving diffracted X-rays from the specimen. Since the soller slit is arranged in a position opposing to the specimen and preferably integrally with the same specimen as well, there is no need of providing a space dedicated to only the soller slit, so that the size of the whole X-ray apparatus can be reduced. As a result, it becomes possible to increase the intensity of X-rays to be received by the X-ray counter.

(5) Another X-ray apparatus according to the present invention comprises an X-ray source for generating X-rays, an X-ray detector for detecting X-rays diffracted by the specimen after being generated by the X-ray source, a monochromator for making X-rays generated by the X-ray source or X-rays diffracted by the specimen monochromatic, and a soller slit. In this X-ray apparatus, the soller slit includes a plurality of metal foils stacked with a constant interval between adjacent foils by spacers. End portions of the stacked metal foils on the side opposite to the spacers constitute an opened end portion. Further, the soller slit is arranged in opposing relation to the monochromator with the opened end portion of the metal foils being in contact with or in the vicinity of the monochromator.

According to this X-ray apparatus including the soller slit having one end portion opened, the monochromator can be arranged in opposing relation to the opened end portion. With this constitution, it is possible to collimate X-rays to parallel X-ray beam by the soller slit, while irradiating the monochromator with X-rays and deriving diffracted X-rays from the monochromator. Since the soller slit is arranged in a position opposing to the monochromator and preferably integrally with the same monochromator, there is no need of providing a space dedicated to only the soller slit, so that the size of the whole X-ray apparatus can be reduced. As a result, it becomes possible to increase the intensity of X-rays to be received by the X-ray counter.

DETAILED DESCRIPTION OF THE PREFERRED EMBODIMENTS

Figure 1:
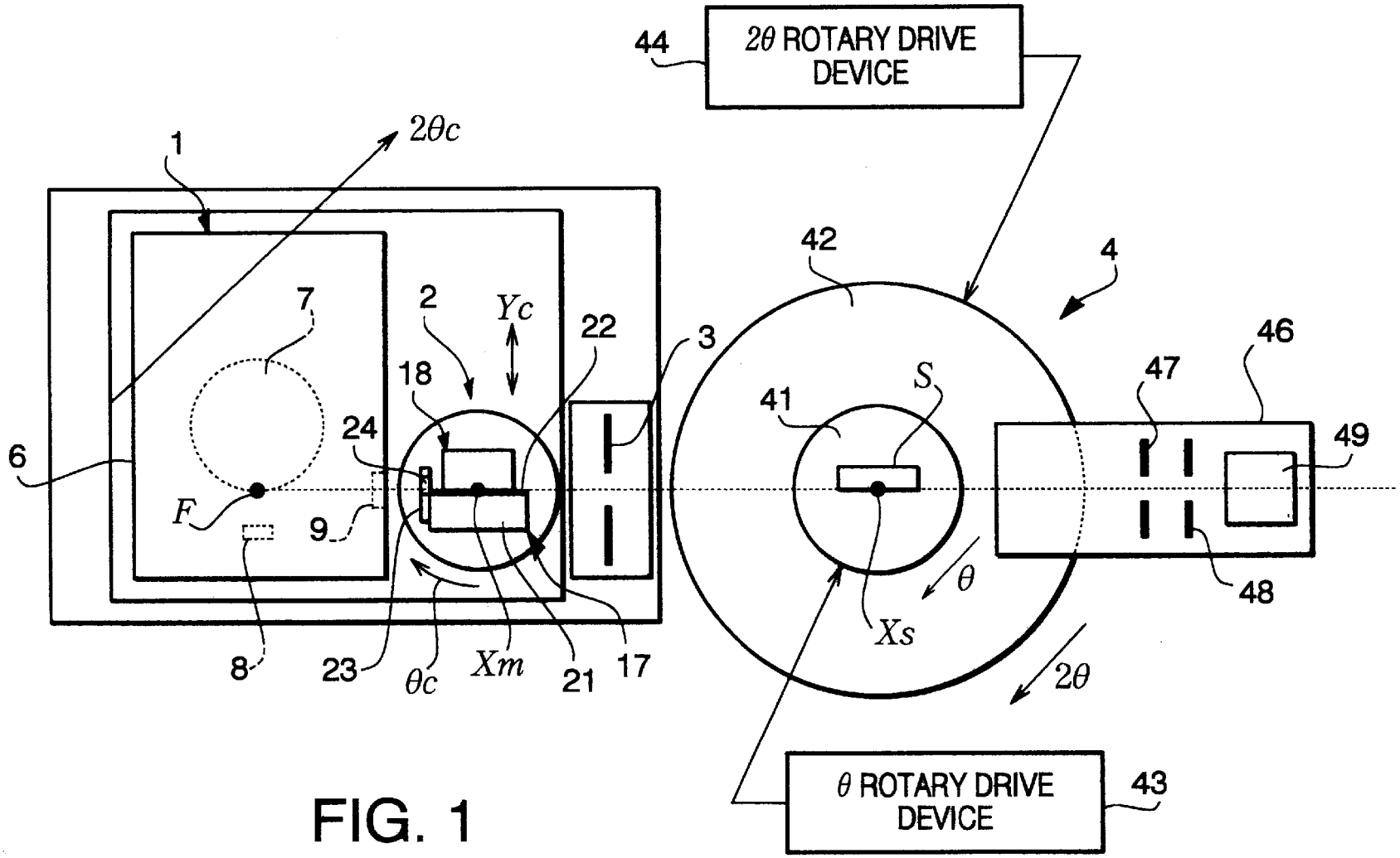
FIG. 1 is a plan view of an embodiment of an X-ray apparatus equipped with a soller slit according to the present invention.

FIG. 1 is a plan view of an X-ray apparatus having a soller slit, according to an embodiment of the present invention. The X-ray apparatus comprises an X-ray generator 1, a monochromator unit 2, a divergence limiting slit 3 and a goniometer 4. A soller slit 18 is arranged within the monochromator unit 2, together with a monochromator 22.

The X-ray generator 1 includes a casing 6, a rotary target 7 housed in the casing 6 and a filament 8 also housed in the casing 6. The filament 8 is heated by applying an electric current thereto to generate thermoelectron. The thermoelectron is accelerated by a voltage applied between the filament 8 and the target 7 and collides with an area of an outer peripheral surface of the target 7. X-rays are emitted from the area of the outer peripheral surface of the target 7, that is, an X-ray focal point F and diverges therefrom. The X-rays are derived externally through an X-ray deriving window 9 provided in an appropriate portion of the casing 6. In this embodiment, the so-called line focus having a length in a direction perpendicular to the drawing sheet of FIG. 1 is considered as the X-ray focal point F.

Figure 2:
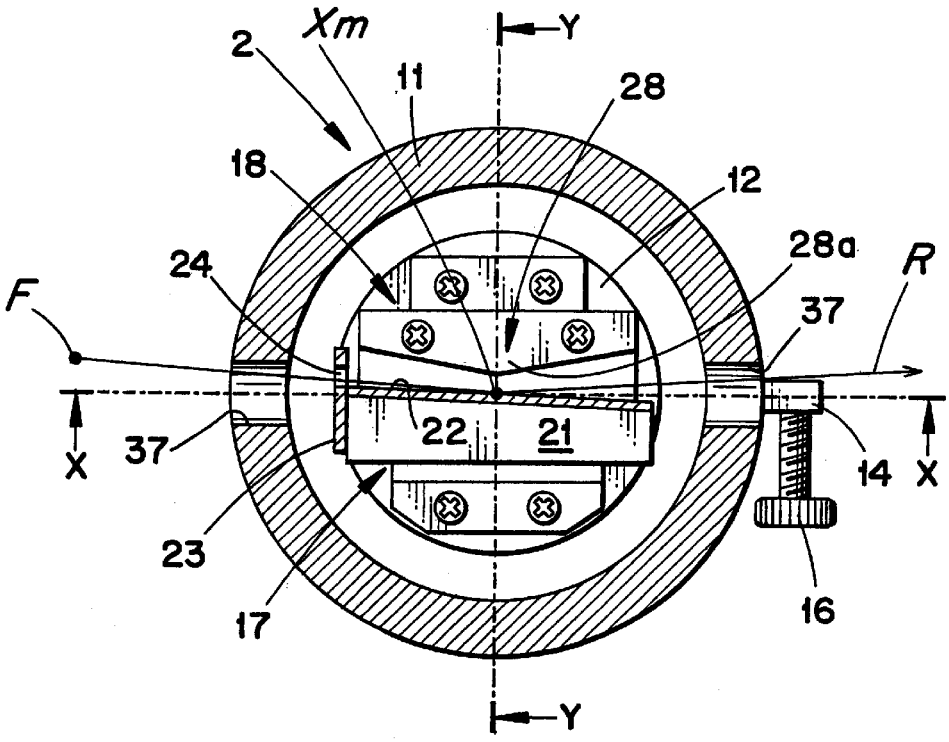
FIG. 2 is a cross sectional plan view of a monochromator, which is a main portion of the apparatus shown in FIG. 1.
Figure 3:
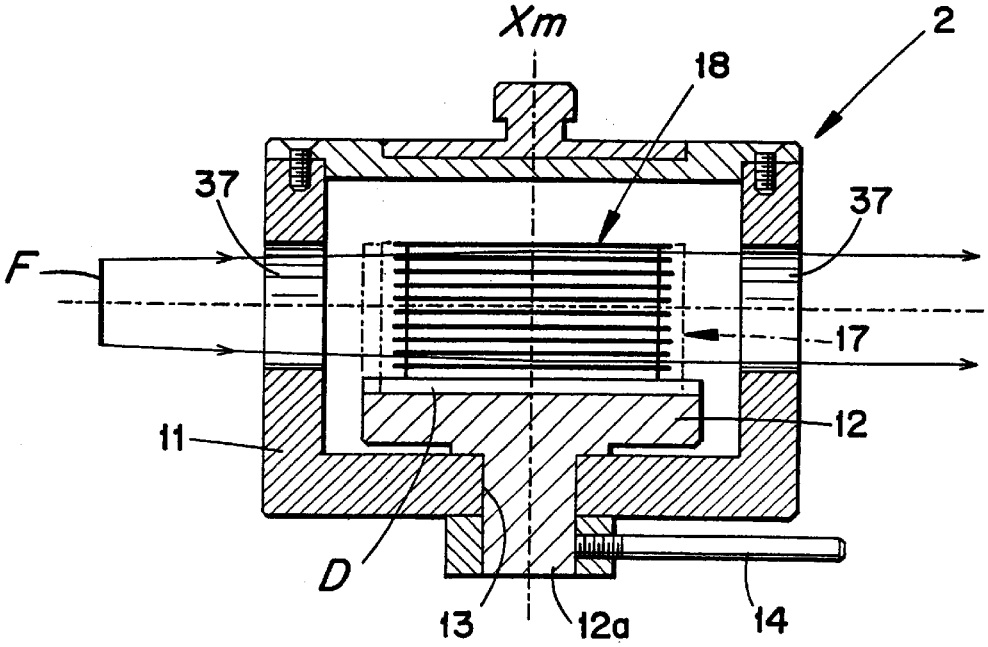
FIG. 3 is a cross section taken along a line X—X in FIG. 2.
Figure 4:
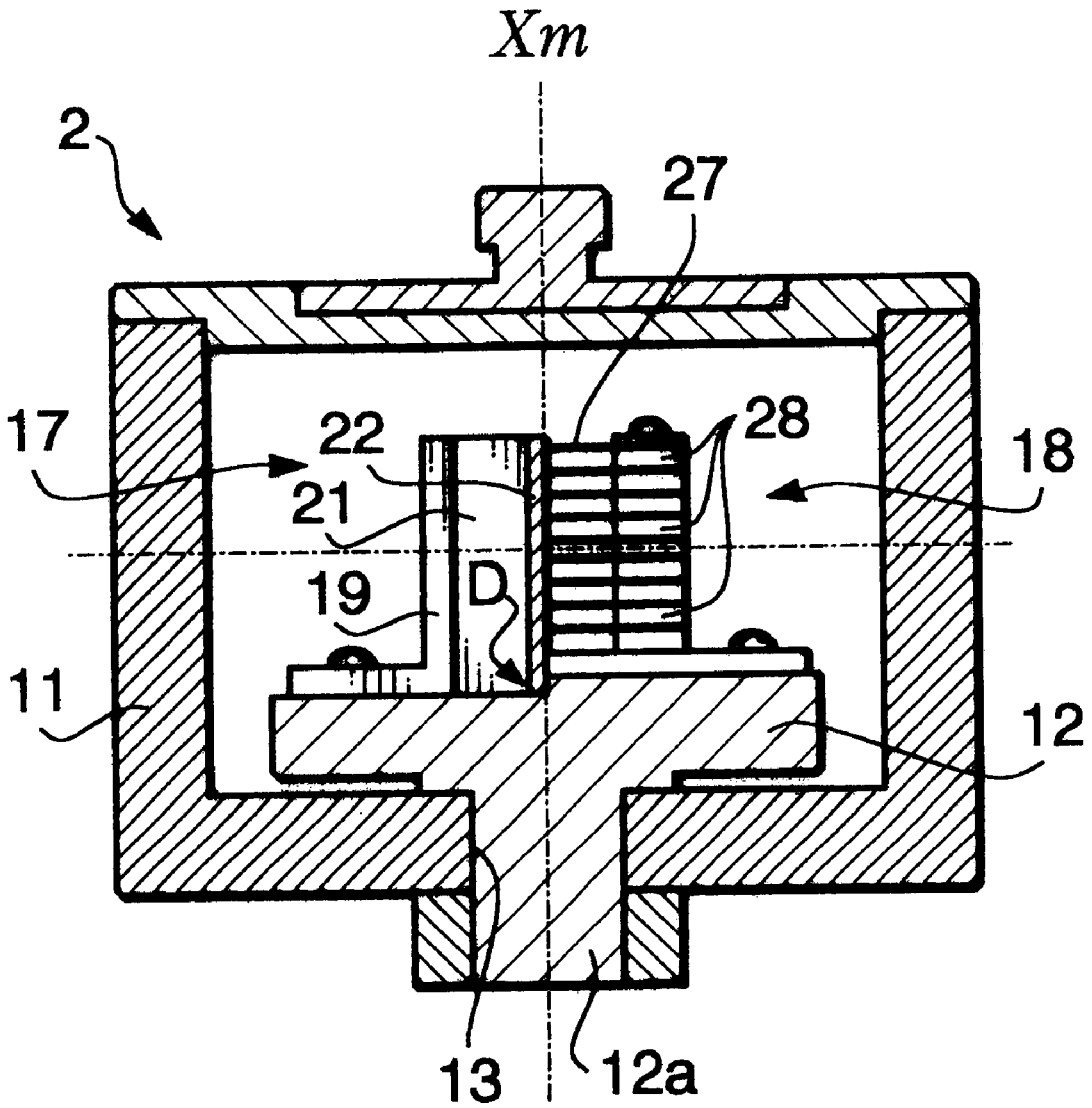
FIG. 4 is a cross section taken along a line Y—Y in FIG. 2.

The monochromator unit 2 has a structure, which is shown in FIG. 2. FIG. 3 is a cross section taken along a line X—X in FIG. 2 and FIG. 4 is a cross section taken along a line Y—Y in FIG. 2. As shown in FIGS. 2 to 4, the monochromator unit 2 includes a cylindrical housing 11 and a monochromator support table 12 housed in the housing 11. The housing 11 is formed in a bottom thereof with a through-hole 13, in which a rotary shaft 12*a* extending form the bottom of the monochromator support table 12 is rotatably fitted. Opposing X-ray transparent windows 37 each having an appropriate size are formed in a peripheral wall of the housing 11 to allow X-ray to pass through the housing 11.

As shown in FIG. 3, a rotary drive bar 14 is connected to a portion of the rotary shaft 12*a,* which protrudes externally of the housing 11. A top end of a thumb screw 16 is in contact with a top portion of the rotary drive bar 14 as shown in FIG. 2, so that a rotation of the thumb screw 16 makes the monochromator support table 12 rotate about a center axis Xm thereof by a desired angle. A step 'D' is formed on an upper surface of the monochromator support table 12 along a center line thereof as shown in FIG. 4. A monochromator assembly 17 is arranged on the lower side of the step 'D' and the soller slit 18 is arranged on the upper side of the step 'D' in an opposing relation to the monochromator assembly 17.

As is clear from FIG. 4, the monochromator assembly 17, the soller slit 18 and the housing 11 are rotatable all together about the axis line Xm of the monochromator. That is, the soller slit 18 is rotated in unison with the monochromator assembly 17.

Figure 5:
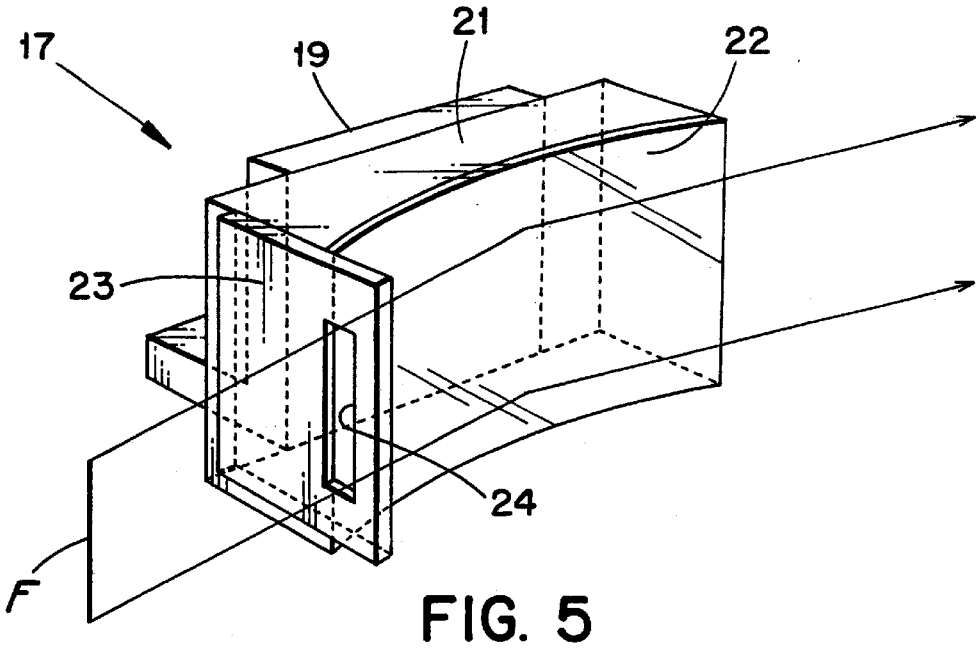
FIG. 5 is a perspective view of a monochromator assembly according to an embodiment of the present invention.
Figure 6:
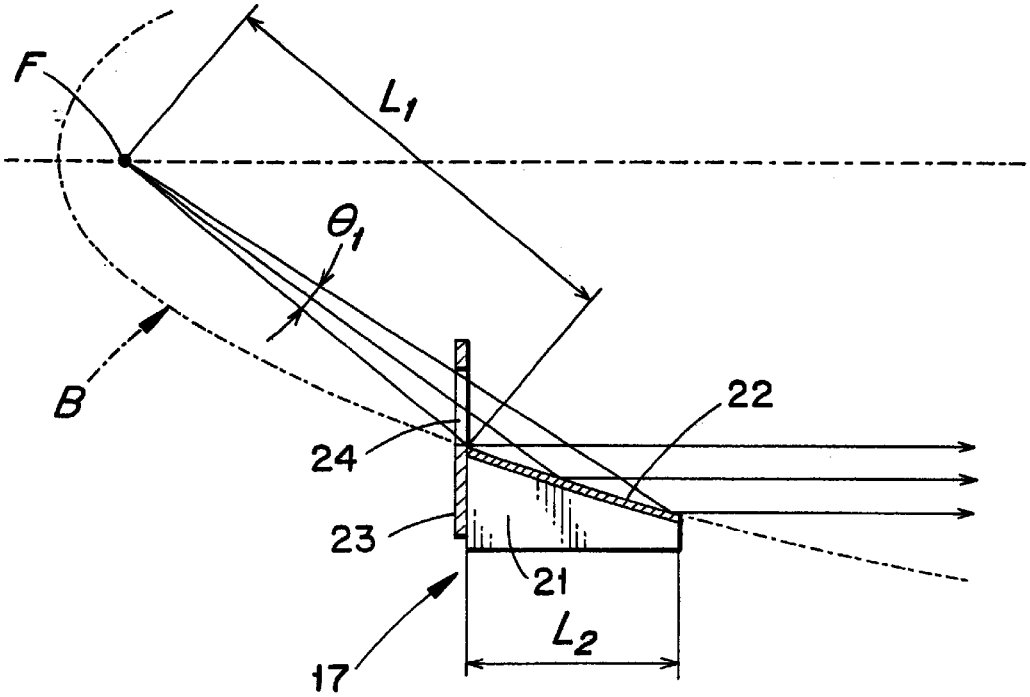
FIG. 6 illustrates a function of a monochromator according to an embodiment of the present invention.

The monochromator assembly 17 includes a support base 21 fixedly connected to a longitudinal side piece of a support member 19 having a 'L'-shaped cross section and a multi-layered monochromator 22 formed on a surface of the support base 21 as films, as shown in FIG. 5. The support base 21 is formed from, for example, a single crystal silicon substrate or a stain-less steal, etc., and a surface thereof, on which the multi-layered monochromator 22 is formed, forms a parabolic line 'B' such as shown in FIG. 6. The monochromator assembly 17 is located in a predetermined position defined by the multi-layered monochromator 22 in contact with the step 'D'.

Figure 11:
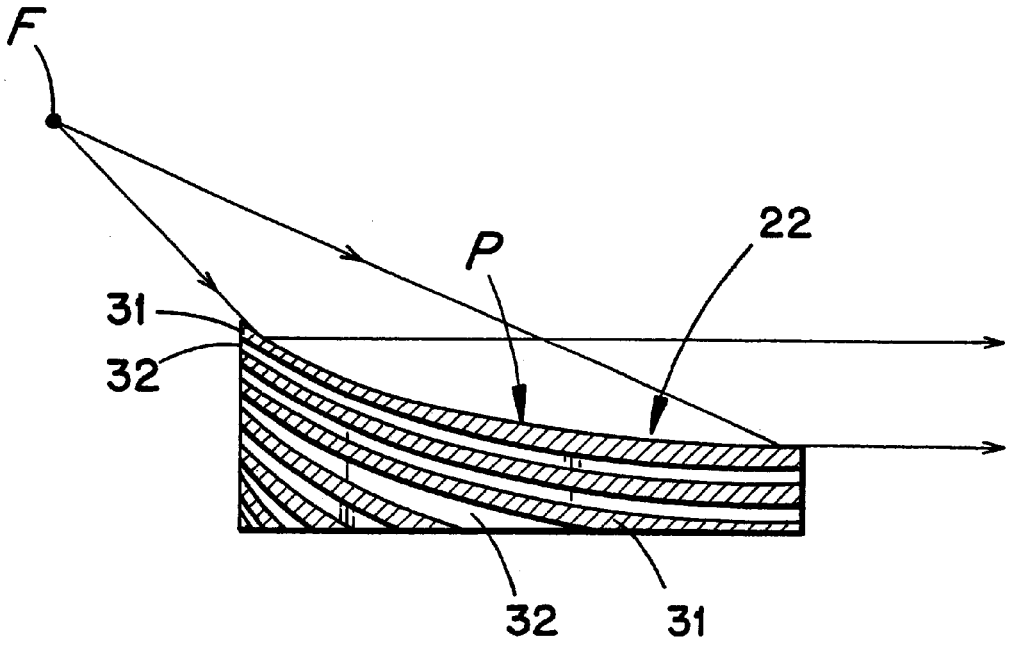
FIG. 11 is a cross sectional side view of a multi-layered monochromator according to another embodiment of the present invention.

The multi-layered monochromator 22 is formed by superimposing heavy element layers 31 and light element layers 32 alternately periodically by using a suitable film forming method such as sputtering, as shown in FIG. 11. Since the surface of the support base 21 is parabolic as shown in FIG. 6, the multi-layered monochromator 22 formed thereon takes in the form of parabolic as well.

Interplaner spacing between lattice planes of the multi-layered monochromator 22 is varied dependently upon location such that X-rays incident thereon at different incident angles are reflected by the multi-layered monochromator 22 to form parallel X-rays. In detail, the interplanar spacing between lattice planes is small at the X-ray incident side where the incident angle of X-rays is large, while being large at the X-ray exit side where the incident angle is small, and besides, the interplanar spacing is continuously changed in an intermediate area.

Figure 10:
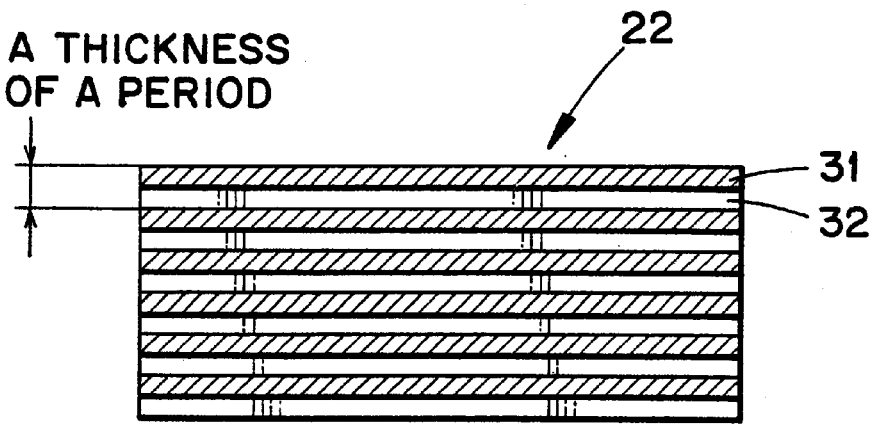
FIG. 10 is a cross sectional side view of a multi-layered monochromator according to an embodiment of the present invention.

It should be noted that the configuration of the surface of the monochromator 22 is not always parabolic and a flat plane surface shown in FIG. 10 may be used in place of the parabolic surface shown in FIG. 11.

As shown in FIG. 6, a slit member 23 is directly fixed to an X-ray incident side end surface of the support base 21. A monochromator slit 24 formed in the slit member 23 is arranged in a position in the X-ray incident side end surface. In this embodiment, the X-ray focal point 'F' is positioned on a center line of the parabolic line 'B', a distance L1 between the X-ray focal point 'F' and the slit 24 is set to 80 mm, X-ray take-in angle θ1 is set to 0.5° and a length L2 of the monochromator 22 is set to 40 mm.

With the above mentioned construction of the monochromator 22, X-ray diverging from the X-ray focal point 'F' is incident on the monochromator 22 while a cross section of the X-rays is restricted by the monochromator slit 24. Subsequently, the X-rays are reflected, and thus, diffracted by the monochromator 22, and then, go out thereof as parallel X-ray beams. Since the multi-layered monochromator 22 having the parabolic shape changes a lot of incident X-rays into diffracted X-rays, it is possible to obtain diffracted X-rays which is much more intense compared with that obtainable by a single crystal monochromator, etc.

Figure 7:
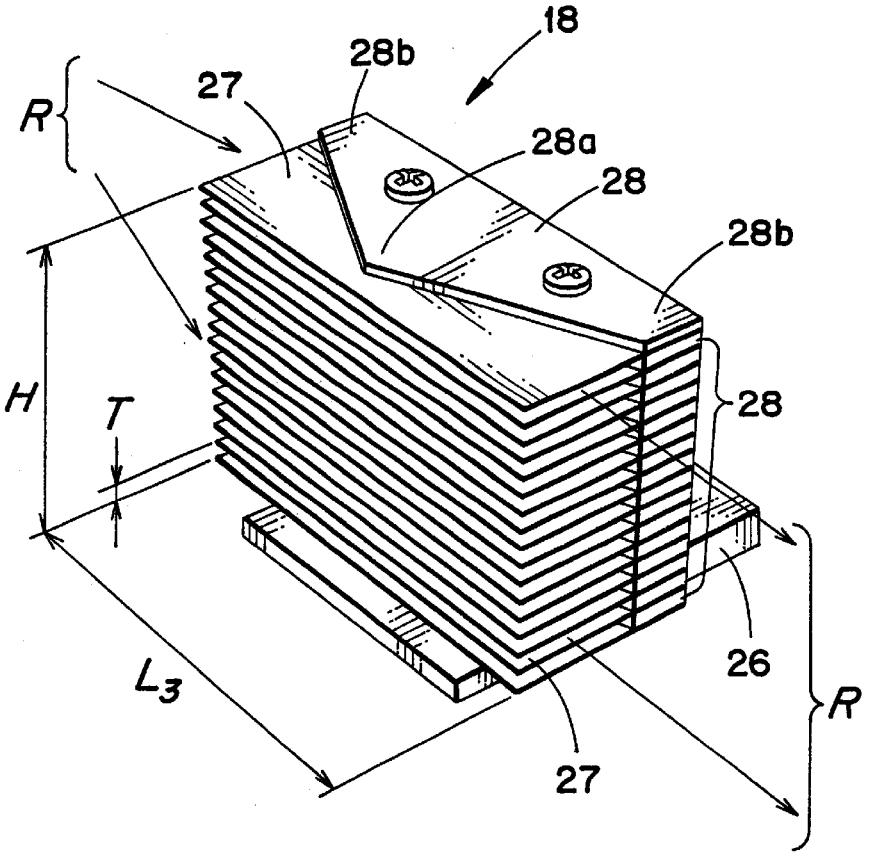
FIG. 7 is a perspective view of a soller slit according to an embodiment of the present invention.

In FIG. 2, the soller slit 18 arranged in opposing relation to the monochromator assembly 17 is constructed by alternately laminating the metal foils 27 and the spacers 28 on the base 26, as shown in FIG. 7. In more detail, the soller slit 18 is constructed by alternately laminating the metal foils 27 and the spacers 28 on the base 26, inserting screws 29 into the lamination, and then, screwing the screws 29 into threaded holes 33 formed in the base 26.

Figure 8:
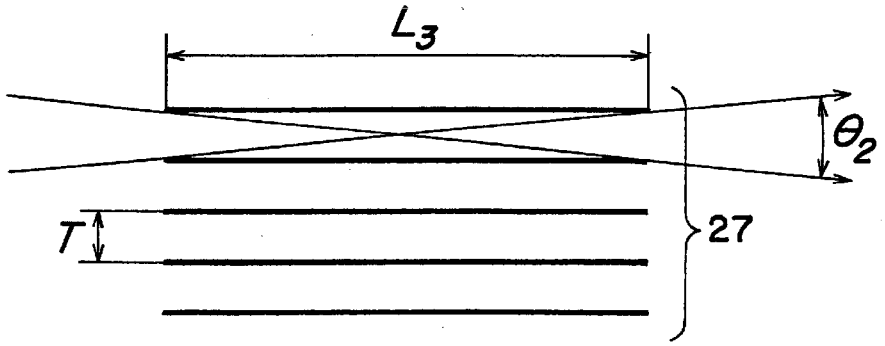
FIG. 8 is a cross section of the soller slit shown in FIG. 7, illustrating a propagation of X-rays within the soller slit.
Figure 9:
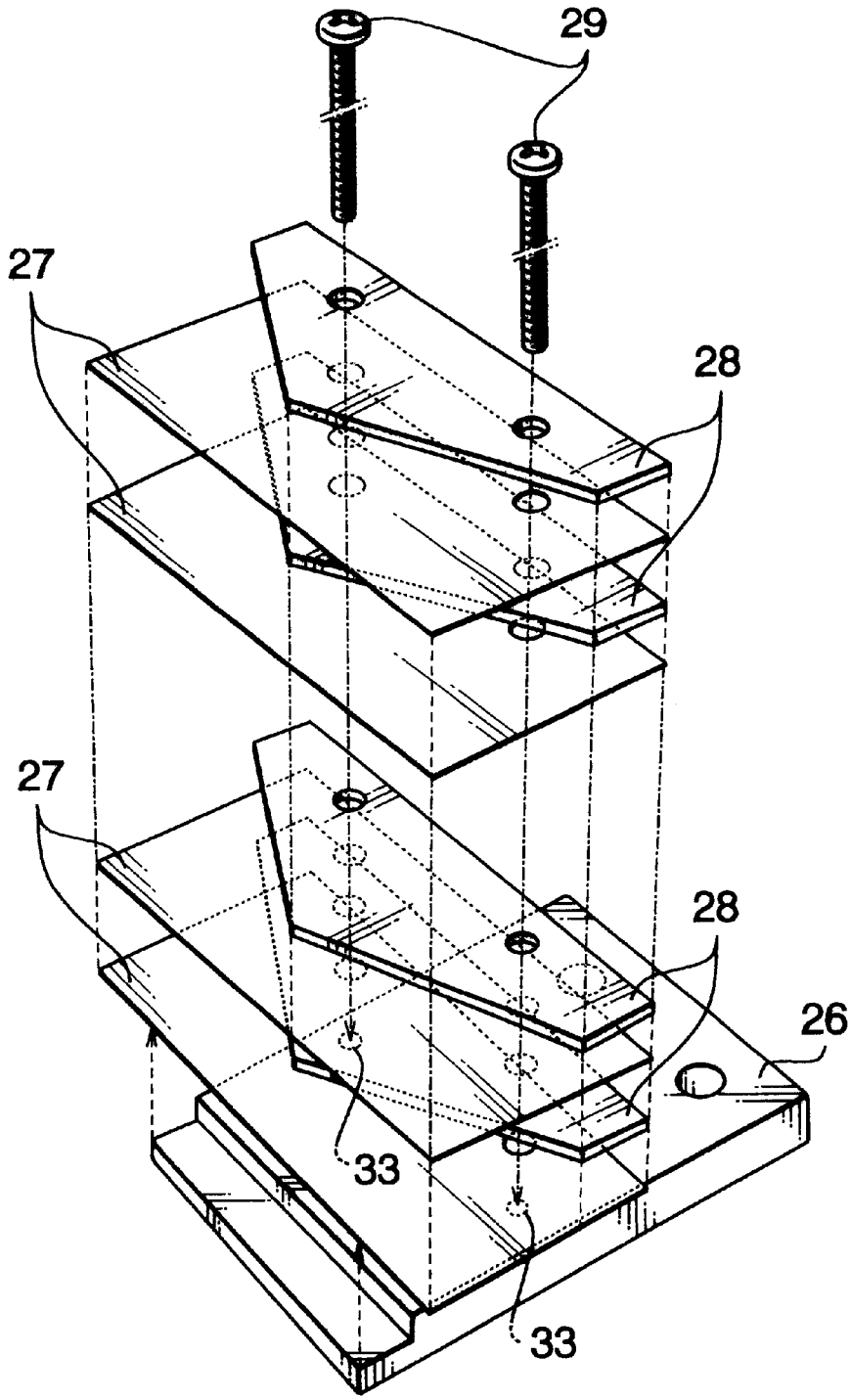
FIG. 9 is a perspective view of the soller slit shown in FIG. 7 in a disassembled state.

The metal foil 27 is formed of any material such as stainless steal, which is impermeable for X-rays. The spacer 28 is formed of, for example, stainless steal or brass. Thickness of the spacer 28, that is, distance 'T' between adjacent metal foils 27, and length L3 of the metal foil 27 are set such that divergence angle θ2 shown in FIG. 8 becomes in the order from 0.5° to 5°. Further, in FIG. 7, height 'H' of the soller slit 18 is set to 10 mm to 20 mm and thickness of the metal foil 27 is set to in the order to 0.05 mm.

The metal foils 27 are supported on one side by the spacers 28 with the other side being opened as free ends, which are in contact with the surface of the monochromator 22 as shown in FIG. 4. Since the surface of the monochromator 22 is parabolic in this embodiment, the free ends of the metal foils 27 are made parabolic correspondingly thereto.

Incidentally, the aimed purpose of the metal foils 27 to collimate the diverging X-rays to parallel X-ray beams also be achieved when the free ends of the metal foils 27 are arranged in the vicinity of the surface of the monochromator 22. That is, the metal foils 27 functions well when a small gap existing between the free ends of the metal foils 27 and the surface of the monochromator 22.

Further, as shown in FIG. 7, the spacer 28 has a delta configuration having a forwardly peaked center portion **28*a* of a front end and both end portions 28*b* thereof behind. In general, the metal foil is very thin and its rigidity is low, so that it is easily warped. However, when the spacers 28 having such delta configuration are used, it is possible to increase the rigidity of the metal foils 27**.

Further, since the delta configuration of the spacer 28 does not constitute any obstacle to propagation of X-rays 'R' diffracted by the monochromator 22 after being emitted from the X-ray focal point 'F', the spacer 28 do not adversely influence on a result of X-ray measurement.

In the X-ray diffraction measurement, it is usual to limit a width of X-rays by arranging slits before and after the specimen 'S' or the monochromator 22. This width limitation is performed in order to remove X-ray components such as scattered X-rays and/or fluorescent X-rays, which degrade S/N ratio. In the strict meaning, however, if a slit is arranged in front of a monochromator, etc., scattered X-rays may be generated by the slit, which may degrade S/N ratio in the result of X-ray measurement. In this embodiment, the peaked center portion **28*a* of the spacer 28, that is, the apex of the delta configuration is positioned in the vicinity of the monochromator 22. Therefore, unnecessary X-rays which may cause noise are effectively removed by the center portion 28*a*** to thereby make S/N ratio high, resulting in a reliable result of measurement.

Returning to FIG. 1, the goniometer 4 includes a θ rotary table 41 rotatable about an axis line Xs of the specimen and a 2θ rotary table 42 rotatable about an axis line Xs of the specimen independently from the θ rotary table 41. The specimen 'S' to be measured is mounted on the θ rotary table 41. A θ rotary drive device 43 is operatively connected to the θ rotary table 41 and a 2θ rotary drive device 44 is operatively connected to the 2θ rotary table 42. These rotary drive devices are constituted with, for example, driving power sources such as electric motors and power transmission mechanisms including, for example, worm gears and worm wheels.

A counter arm 46 is mounted on an appropriate position on the 2θ rotary table 42. A scattered X-ray limiting slit 47, a light receiving slit 48 and an X-ray counter 49 are fixedly mounted in appropriate positions on the counter arm 46. The scattered X-ray limiting slit 47 functions to prevent scattered X-rays generated from various members arranged in the vicinity of the X-ray passage from taking in the X-ray counter 49. The light receiving slit 48 functions to determine the width of X-rays incident on the X-ray counter 49.

An operation of the X-ray apparatus including the soller slit will now be described. Prior to an X-ray measurement with using the X-ray apparatus shown in FIG. 1, the various constitutional components of the X-ray apparatus are positioned in constant positions with respect to the X-ray optical axis. Thus, the optical axis regulation is carried out.

For example, an angle 2θc of the X-ray focal point 'F' with respect to the monochromator 22 and an angle θc of the monochromator 22 about the axis line Xm thereof are set to calculated angle positions, respectively. Subsequently, the angle θc of the monochromator 22 is finely regulated by rotating the thumb screw 16 shown in FIG. 2. Further, the angle 2θc of the X-ray focal point 'F' is finely regulated. Then, the monochromator 22 is finely regulated in a direction Yc perpendicular to the X-ray optical axis. In finely regulating these angles and the monochromator, intensity of X-rays counted by the X-ray counter 49 is measured to find out the positions at which the intensity becomes maximum. The angle position of the monochromator 22 at which the X-ray intensity becomes maximum is the best position of the monochromator 22 with respect to the optical axis of the X-ray.

Positional regulation of other constitutional components than the monochromator unit 2, for example, the divergence limiting slit 3, the scattered X-ray limiting slit 47 and the light receiving slit 48, etc., with respect to the optical axis of the X-ray is performed by using known methods.

Figure 12:
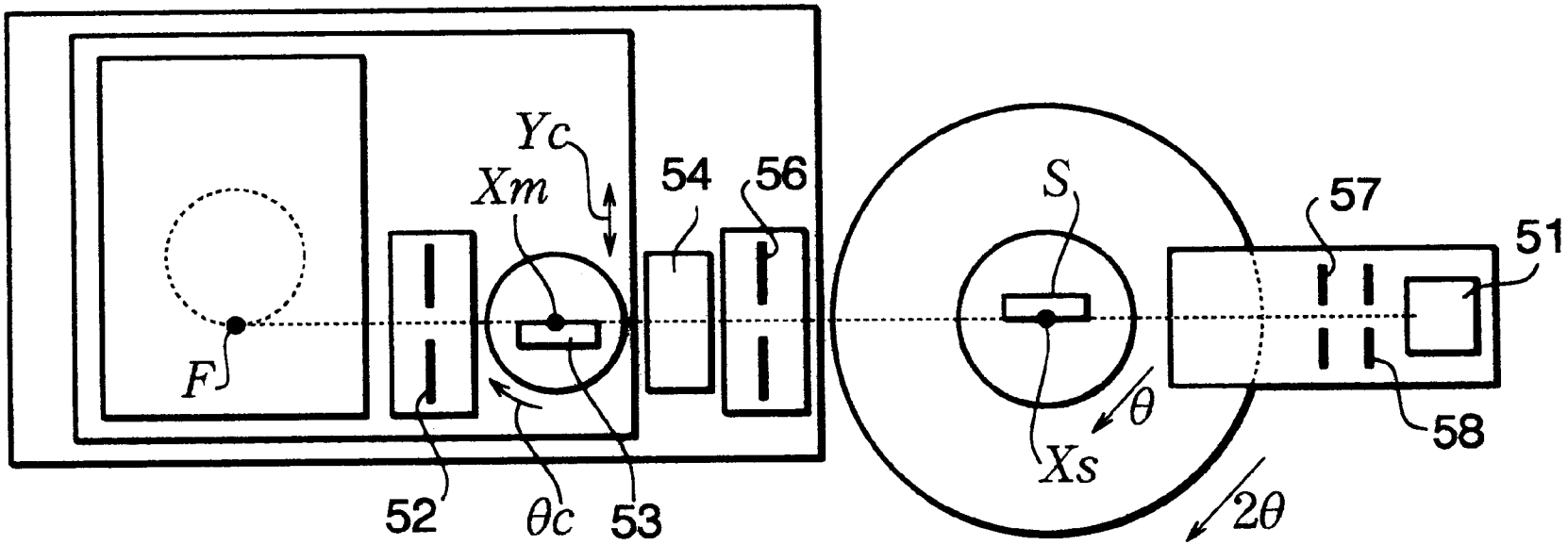
FIG. 12 PRIOR ART
FIG. 12 is a plan view showing an example of a conventional X-ray apparatus.
Figure 13:
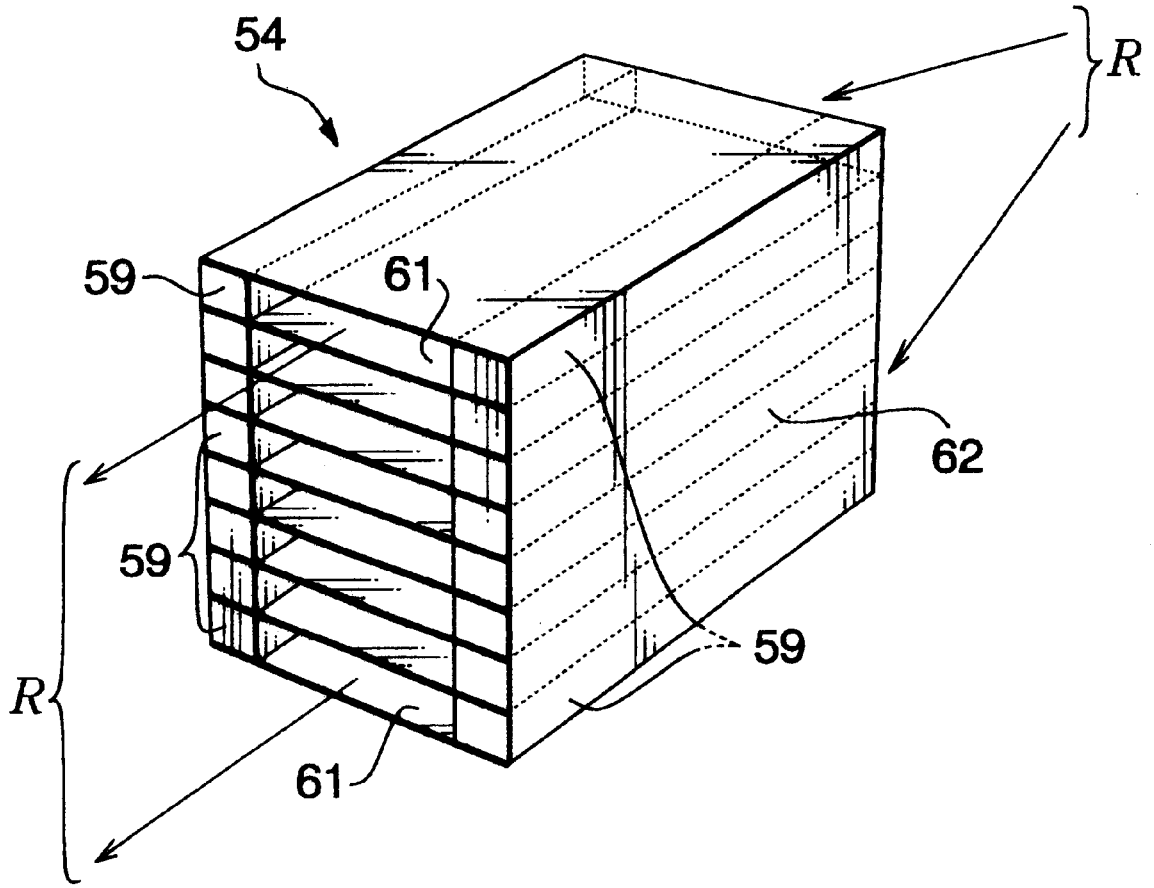
FIG.13 PRIOR ART
FIG. 13 is a perspective view of an example of a conventional soller slit.

Depending upon an X-ray apparatus, the monochromator 53 and the monochromator slit 52 may be provided separately as shown in FIG. 12. In such X-ray apparatus, it is necessary to regulate positions thereof independently, while keeping them in a mutually related state. However, such work is complicated and time consuming.

On the contrary, the monochromator slit 24 is always fixed in the constant position with respect to the monochromator 22 by mounting the monochromator 24 directly in the predetermined position on the X-ray incident side end surface of the monochromator 22 as shown in FIG. 1. Thus, in regulating the monochromator unit 2 in the predetermined position with respect to the optical axis of X-ray, it is enough to regulate only the monochromator 22, while there is no need of executing a specific position regulation work for the monochromator slit 24. As a result, the work for regulating the position of the monochromator unit 2 corresponding to the X-ray optical axis becomes very simple, so that the work is performed reliably and rapidly.

After the regulation of the position of various constitutional components in the X-ray apparatus corresponding to the X-ray optical axis is completed in the manner mentioned above, the measurement using X-rays is performed. First, as shown in FIG. 2, the housing 11 is set around the monochromator assembly 17 and the soller slit 18 in such a way that intensity of X-rays passing through the monochromator unit 2 becomes high enough to perform the X-ray measurement.

Then, as shown in FIG. 1, the specimen 'S' is mounted in a predetermined position on the θ rotary table 41, and then, X-rays are generated from the X-ray focal point 'F'. X-rays thus generated are introduced into the monochromator unit 2 to be incident on the monochromator 22, as shown in FIG. 2. At this moment, X-rays are diffracted by the monochromator 22 to be made monochromatic at a predetermined wavelength. Since, in this embodiment, the interplanar spacing between lattice planes of the monochromator 22 is regulated differently in the longitudinal direction thereof, that is, in the propagating direction of X-rays, X-rays incident on the monochromator 22 can be diffracted by the whole surface of the monochromator 22. Therefore, a highly intense X-rays can be obtained from the monochromator 22.

Further, since the surface of the monochromator 22 is parabolic, X-rays emitted from the monochromator 22 are derived as parallel beams, particularly, parallel in a horizontal direction. That is, according to the monochromator 22 according to this embodiment, monochromator and highly intense X-ray beams parallel in the horizontal direction can be obtained.

As shown in FIG. 2, the soller slit 18 is arranged in the facing relation to the monochromator 22 in such a manner that the top ends of the metal foils 27 come in contact with or in the vicinity of the surface of the monochromator 22. Therefore, X-ray beams to be made parallel to the horizontal direction by the monochromator 22 is made parallel to a vertical direction by the soller slit 18 as well.

In the conventional X-ray apparatus shown in FIG. 12, the soller slit 54 is arranged in the position remote from the monochromator 53. Therefore, a space corresponding to the distance therebetween is required. On the contrary, in the X-ray apparatus of this embodiment shown in FIG. 1, the soller slit 18 is incorporated in the monochromator unit 2. Therefore, the space dedicated to only the soller slit 18 is unnecessary, so that the X-ray apparatus can be reduced in size or there is a space provided around the goniometer 4. In addition, intensity of the X-ray is increased.

Parallel and monochromatic X-ray beams having a high intensity obtained by the monochromator unit 2 are incident on the specimen 'S' as shown in FIG. 1. When the X-ray measurement is performed on the basis of the parallel beam method, parallel beams are incident on the specimen 'S' by a low angle, that is, at a very small incident angle. A part of such incident X-rays are diffracted by the specimen 'S' and detected by the X-ray counter 49 to calculate the intensity thereof.

On demand, the θ rotary table 41 is rotated continuously or intermittently at a predetermined angular velocity and, simultaneously, the 2θ rotary table 42 is rotated in the same direction at an angular velocity which is twice the angular velocity of the θ rotary table 41, during a time for which X-rays are incident on the specimen 'S'. Both the diffraction angle and the intensity of X-rays diffracted by the specimen 'S' can be measured during such rotations of the tables.

As mentioned, since the one sides of the metal foils 27 of the soller slit 18 are made the opened end in the X-ray apparatus according to this embodiment of the present invention, the open end portion can be arrange in facing relation to the surface of the monochromator 22. Therefore, there is no need of providing the space dedicated to only the soller slit 18 on the optical axis of X-rays. As a result, it is possible to reduce the size of the whole X-ray apparatus.

Further, since the soller slit 18 is mounted directly on and preferably integrally with the monochromator 22, it is possible to automatically determine the relative positions thereof. As a result, there is no need of separately regulating the positions of the monochromator 22 and the soller slit 18 with respect to the optical axis of X-rays prior to the X-ray measurement. Therefore, the optical axis regulation work is very easily performed for the various constitutional components in the X-ray apparatus.

Although the present invention has been described with reference to the preferred embodiments, the present invention is not limited to the described embodiments and can be modified or changed within a true scope of the present invention which is defined by the appended claims.

For example, the soller slit 18 is arranged in the opposing relation to the monochromator 22 arranged in between the X-ray focal point 'F' and the specimen 'S' in the embodiment shown in FIG. 1. However, in place of or in addition to the soller slit 18, a soller slit having an open end portion according to the present invention can be arranged in an opposing relation to the specimen 'S'.

There is an X-ray apparatus in which a monochromator is arranged between a specimen 'S' and an X-ray counter 49. In such apparatus, the soller slit according to the present invention may be arranged in an opposing relation to the monochromator.

Referring to FIG. 2, the monochromator unit has the monochromator having the parabolic X-ray diffraction plane such as shown in FIG. 6. However, it is, of course, possible to apply the present invention to a monochromator having a flat X-ray diffraction plane as well. Further, a single crystal monochromator or other usual monochromators can be used in place of the multi-layered monochromator.

The X-ray apparatus shown in FIG. 1 is a mere example, so that the X-ray generator 1, the goniometer 4, etc. may have other structures than those shown in the drawings.

What is claimed is:

1. A soller slit comprising a plurality of metal foils and a plurality of spacers, the plurality of said spacers being laminated alternatively with the plurality of said metal foils to support one end portions of said metal foils with a space between adjacent metal foils.

the other end portions of said metal foils being opened.

2. A soller slit as claimed in claim 1, wherein each said spacer has a center portion protruding forward and both side portions being behind.

3. A soller slit as claimed in claim 2, wherein said center portion of said spacer takes in the form of an apex of a mountain.

4. An X-ray apparatus comprising an X-ray source for generating X-rays, an X-ray detector for detecting X-rays diffracted by a specimen after being generated from said X-ray source, and a soller slit, wherein said soller slit includes a plurality of metal foils and a plurality of spacers, the plurality of said spacers being laminated alternatively with the plurality of said metal foils to support one end portions of said metal foils with a space between adjacent metal foils, the other end portions of said metal foils being opened, and wherein said the other end portions of said metal foils are arranged in contact with or in the vicinity of a surface of said specimen.

5. An X-ray apparatus comprising an X-ray source for generating X-rays, an X-ray detector for detecting X-rays diffracted by a specimen after being generated from said X-ray source, a monochromator for making X-rays generated by said X-ray source or X-rays diffracted by said specimen monochromatic, and a soller slit, wherein said soller slit includes a plurality of metal foils and a plurality of spacers, the plurality of said spacers being laminated alternatively with the plurality of said metal foils to support one end portions of said metal foils with a space between adjacent metal foils, the other end portions of said metal foils being opened, and wherein said the other end portions of said metal foils are arranged in contact with or in the vicinity of a surface of said monochromator.

* * * * *